United States Patent [19]

Pollard

[11] 4,359,159

[45] Nov. 16, 1982

[54] CARTON ASSEMBLY FOR PRESLICED PASTRY

[76] Inventor: Clarice F. Pollard, 4502 N. 36th St., Phoenix, Ariz. 85018

[21] Appl. No.: 136,974

[22] Filed: Apr. 3, 1980

[51] Int. Cl.[3] ..... A45C 11/20

[52] U.S. Cl. ..... 206/551; 206/45.32

[58] Field of Search ..... 206/551, 45.32, 303, 206/497; 211/127, 128; 220/4

[56] References Cited

U.S. PATENT DOCUMENTS

| | | | |
|---|---|---|---|
| 2,338,930 | 1/1944 | Gordon | 206/303 |
| 3,280,987 | 10/1966 | Steinbock | 206/303 |
| 3,335,846 | 8/1967 | Mills | 206/551 |
| 3,398,827 | 8/1968 | Laskin | 206/551 |
| 3,960,268 | 6/1976 | Davis et al. | 206/497 |
| 4,122,949 | 10/1978 | Blatt | 206/303 |

FOREIGN PATENT DOCUMENTS

| | | | |
|---|---|---|---|
| 927122 | 5/1973 | Canada | 206/551 |
| 551921 | of 1958 | Italy | 206/303 |
| 392373 | 5/1965 | Switzerland | 206/303 |

*Primary Examiner*—Joseph Man Fu Moy
*Attorney, Agent, or Firm*—Don J. Flickinger

[57] ABSTRACT

Each segment of a presliced pastry is held in a server having an upright panel with flaps extending under and over the segment. The several servers are supported on the tray of a holder in a configuration which approximates the uncut pastry. The holder further includes a removable cover which is urged downwardly for compressive retention of the several servers during transportation.

6 Claims, 7 Drawing Figures

CARTON ASSEMBLY FOR PRESLICED PASTRY

BACKGROUND OF THE INVENTION

1. Field of the Invention

This invention relates to packaging for food products.

More particularly, the present invention relates to holders for presliced pastry.

In a further aspect, the instant invention concerns a carton for packaging a plurality of individually servable pastry segments.

2. Description of the Prior Art

Pastry items, such as pies and cakes, are commonly produced in a larger size which require slicing into smaller individual servings. By conventional practice, circular pastries are cut into sectors or wedge-shaped segments. Square or rectangular items are generally sliced into square or rectangular segments.

For convenience, especially in commercial food establishments, the entire pastry is usually presliced. The several slices, undisturbed and retained in the original unsliced configuration, are stored and displayed in a holder having a tray and cover. Such holders, usually fabricated of plastic or the like, are readily and commercially available. A serving is had by removing the cover, lifting a selected segment from the tray, and replacing the cover.

The foregoing procedure, however, has proven to be less than satisfactory. The shelf life of presliced pastry is considerably foreshortened. Flavor, texture and appearance deteriorate rate usually as a result of loss of moisture. Periodic dislodgment of the cover during removal of a segment accelerates the deterioration. Further, an individual segment is not immediately servable. At a minimum, the slice is placed upon a serving dish. For a slice which is to be carried from the premises, such as at convenience food stores and carry-out restaurants, individual packaging is required. In addition to the impositions of time and effort, packaging may have further deleterious effects upon the pastry segment. Wrapping paper, for example, usually mashes into the icing upon cake segments.

It would be highly advantageous, therefore, to remedy the deficiencies inherent in prior art. Accordingly, it is an object of the present invention to provide improved means for storing, preserving and packaging pastry.

Another object of the invention is the provision of a carton assembly for segments of presliced pastry.

And another object of the invention is to provide packaging means which will materially extend the shelf life of presliced pastry.

Still another object of this invention is the provision of a carton assembly from which the individual segments are readily servable.

Yet another object of the invention is to provide a carton assembly which holds the pastry on display.

Yet still another object of the invention is the provision of a carton assembly in which each segment of pastry is held in an individual server.

A further object of the instant invention is to provide an improved holder for carrying the several individual servers.

And a further object of the invention is the provision of a pastry holding and storing unit from which a selected pastry segment is readily removable without effect upon remaining segments.

Yet a further object of the invention is to provide a carton assembly which is especially adapted for quick, convenient carry-out food service.

And still a further object of the invention is the provision of a carton assembly of the above type which is sufficiently economical to manufacture to be considered disposable.

SUMMARY OF THE INVENTION

Briefly, to achieve the desired objects of the carton assembly of the instant invention, in accordance with a preferred embodiment thereof, first provided is a plurality of servers, each holding one of the presliced pastry segments. Next provided is a holder having a tray for supporting the plurality of servers and a cover overlying the plurality of servers. Retention means are also provided for urging the cover toward the tray and for retaining the plurality of servers between the tray and the cover.

In accordance with a further embodiment of the invention, each server includes an upright panel having a height greater than the height of the pastry segments. First the second flaps extend from the upright panel under and over, respectively, the segment. The retention means, which may include an elongate element extending between the tray and the cover, holds the several upright panels in compression between the tray and the cover.

BRIEF DESCRIPTION OF THE DRAWINGS

The foregoing and further and more specific objects and advantages of the instant invention will become readily apparent to those skilled in the art from the following detailed description of preferred embodiments thereof, taken in conjunction with the drawings, in which.

DESCRIPTION OF THE PREFERRED EMBODIMENTS

Figure 1:
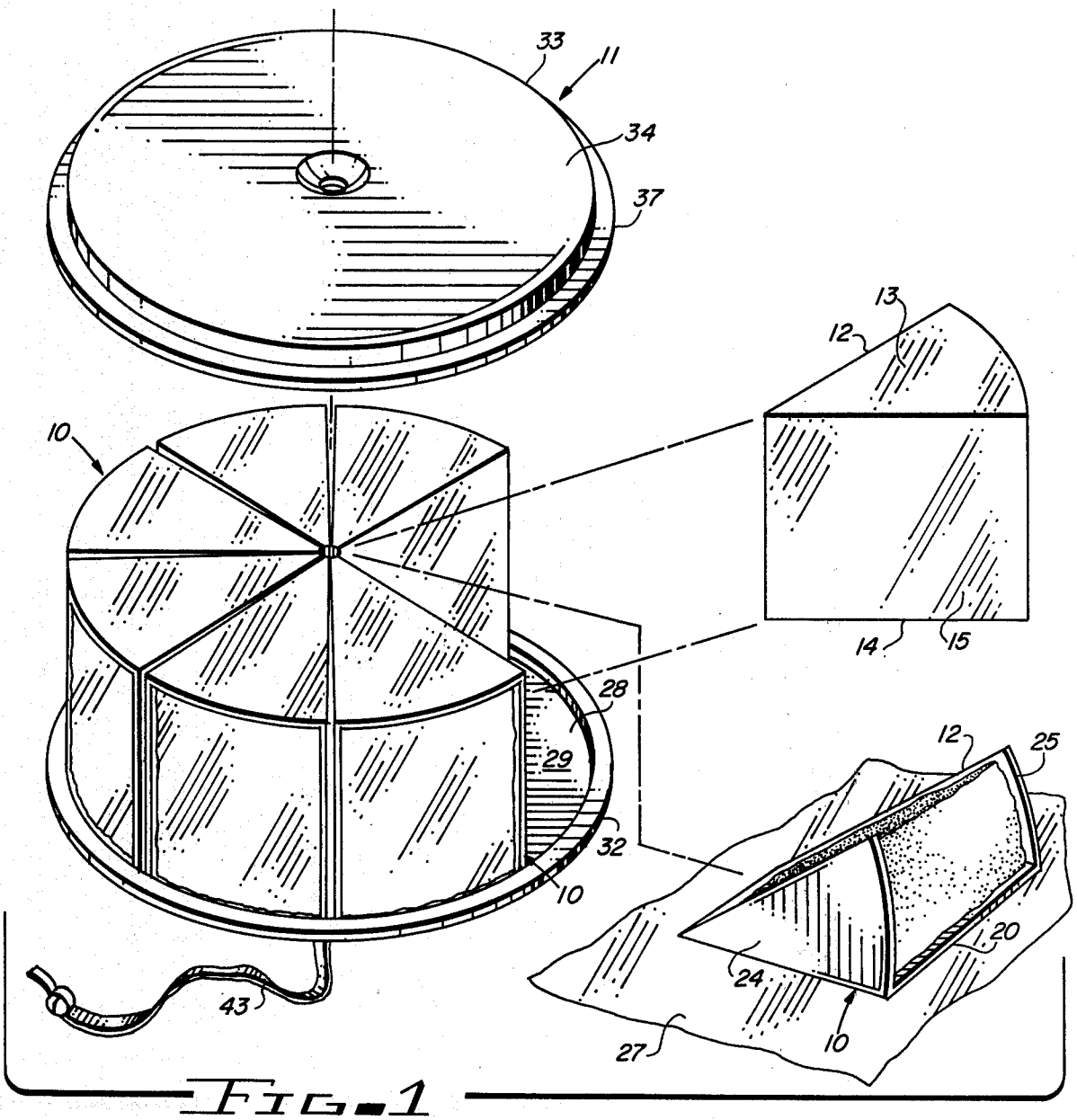
FIG. 1 is an exploded perspective view of a carton assembly constructed in accordance with the teachings of the instant invention as it would appear in use with a presliced pastry.

Turning now to the drawings in which like reference numerals indicate corresponding elements throughout the several views, attention is first directed to FIG. 1 which shows a carton assembly of the instant invention in which a plurality of servers, each generally designated by the reference character 10, are supported by a holder generally designed by the reference character 11.

For purposes of illustration, the carton assembly of FIG. 1 is shown as it would be configured to accommodate a cylindrical pastry item, such as cake, which has been presliced into a plurality of sectors or wedge-shaped segments 12. Each segment 12 includes the normal top, bottom and sides 13, 14 and 15, respectively. As will readily occur to those skilled in the art, segment 12 includes three sides 15. It will also be appreciated that the device of the instant invention having analogous components, may be configured to accommodate rectangular pastry items which are sliced into square or rectangular segments, each having four sides.

Figure 2:
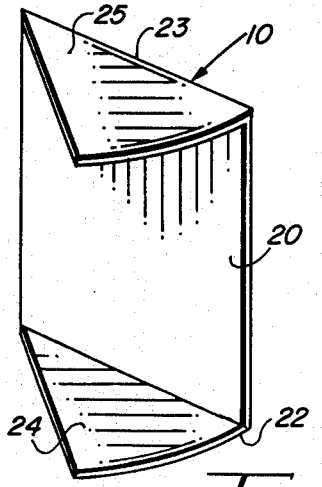
FIG. 2 is a perspective view of an individual server, a plurality of which are incorporated into the carbon assembly of FIG. 1.
Figure 3:
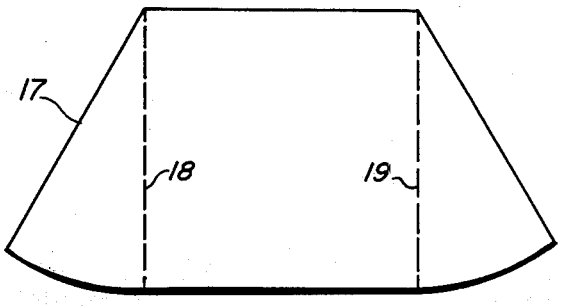
FIG. 3 is a plan view of an individual server as it would appear prior to folding into the configuration illustrated in FIG. 2.

With reference to FIGS. 2 and 3, it is seen that each server 10 is readily fabricated from a sheet 17 which is twice folder as indicated by the broken lines 18 and 19. In accordance with conventional practice, sheets of the type are readily dye cut from cardboard, plastic or other commercially available material and folded either manually or by machine. Server 10, the folded sheet 17, includes upright panel 20 having lower edge 22 and upper edge 23 from which extend first flap 24 and second flap 25, respectively. The height of upright panel 20, the distance between lower edge 22 and upper edge 23, is greater than the height of segment 12.

Referring again to FIG. 1, it is seen that upright panel 20 is positioned adjacent one side 15 of segment 12 with first flap 24 extending under bottom 14 and second flap 25 extending over top 13. Server 10 with segment 12 in place, is encased in a disposable, flexible wrap 27 in accordance with practices well established within the art. Such wrapping 27 is preferrably accomplished with a thin, transparent, plastic film to preserve and extend the shelf life of the item so wrapped and concurrently present the item for visual display.

Figure 4:
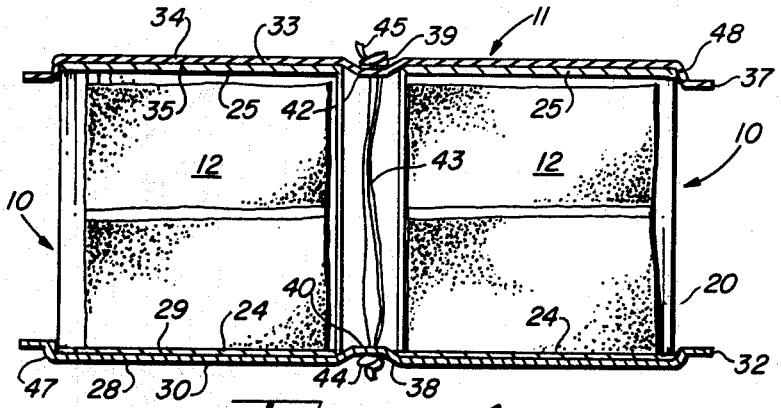
FIG. 4 is a vertical sectional view taken along the longitudinal axis of the assembled embodiment of FIG. 1.

Holder 11, illustrated in FIGS. 1 and 4, includes tray 28 having top surface 29, bottom surface 30 and peripheral edge 32 and cover 33 including top surface 34, bottom surface 35 and peripheral edge 37. The several individual servers 10 are supported upon top surface 29 of tray 28 in a configuration which approximates the unsliced pastry item. Cover 33, overlying the several servers 10, in accordance with the immediate embodiment, is a substantial duplicate of tray 28. A generally centrally located indentation 38 is formed in bottom surface 30 of tray 28. A similar generally centrally located indentation 39 is formed in top surface 34 of cover 33. Apertures 40 and 42 extend through indentations 38 and 39, respectively. Elongate securement element 43 secures cover 33 to tray 28. Lower end 44 of securement element 43 extends through aperture 40 and is mechanically, adhesively or otherwise secured within indentation 38. Upper end 45 of securement element 43 extending through aperture 42 is sufficiently flexible to be entwined in a knot or other readily formed nodule which resides within indentation 39.

Apertures 40 and 42 and securement element 43 provide retention means for urging cover 33 toward tray 28 and retaining the several servers 10 therebetween. For this purpose, securement element 43 can be sufficiently tensioned to place the several upright panels 20 in compression between tray 28 and cover 33 for retention of servers 10. Securement element 43 is readily fabricated of the commercially available paper or plastic covered wire element commonly referred to as a "twist-tie."

The immediate embodiment of the instant invention includes additional retention means in the form of upstanding annular lip 47 proximate peripheral edge 32 of tray 28 and depending annular lip 48 proximate peripheral edge 37 of cover 33. Lips 47 and 48 are especially desirable where it is anticipated that the carton assembly of the instant invention will be subjected to abusive treatment during transporation. However, it is within the scope of the instant invention that lips 47 and 48 are optional and that tray 28 and top 33 may be formed as planar units. Such planar units may also dispense with indentations 38 and 39.

Figure 5:
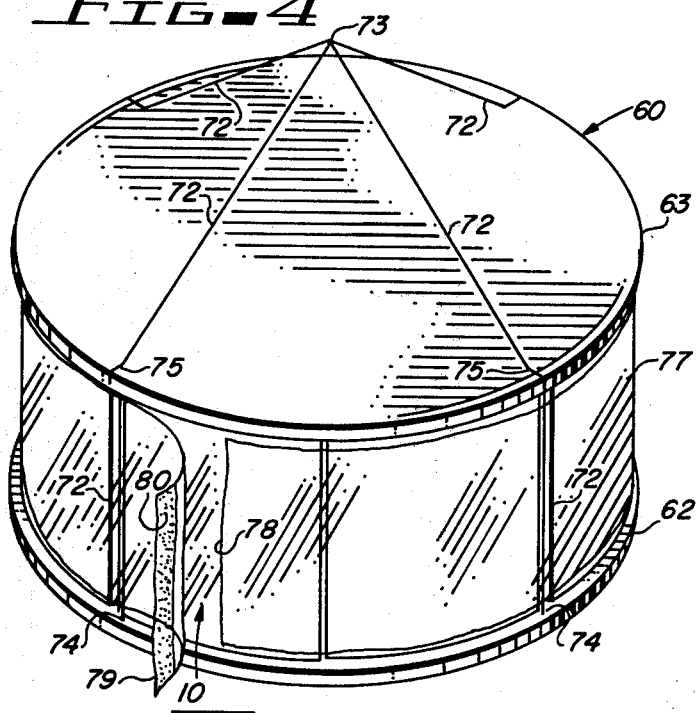
FIG. 5 is a perspective view of an alternate embodiment of the instant invention.
Figure 6:
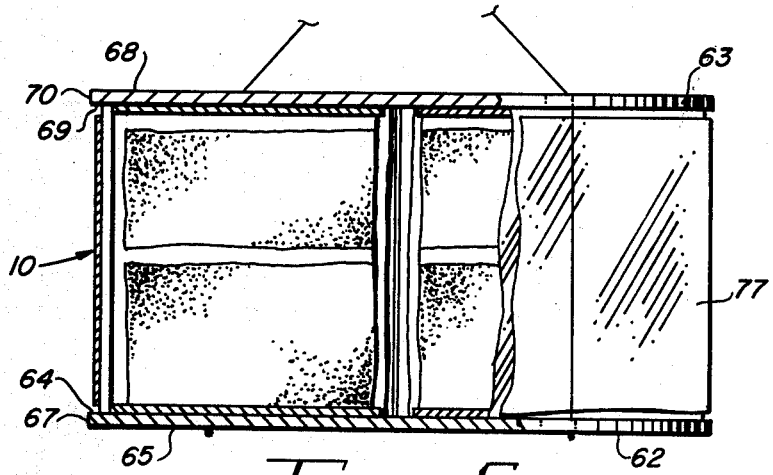
FIG. 6 is an elevation view, partly in section, of the embodiment of FIG. 5.

FIGS. 5 and 6 illustrate an alternately preferred embodiment of the instant invention in which holder 60 includes tray 62 and cover 63 analogous to the previously described corresponding elements. Tray 62 includes top surface 64, bottom surface 65 and peripheral edge 67 while cover 63 includes top surface 68, bottom surface 69 and peripheral edge 70. It is noted that tray 62 and top 63 are planar and do not include indentations nor lips.

A plurality of servers 10 are arranged and supported upon top surface 64 of tray 62 as previously described. Bottom surface 69 of cover 63 rests upon the plurality of servers 10. Retention means, in accordance with the immediate embodiment, includes a plurality of elongate flexible tie elements 72 such as may be readily fabricated of string, lightweight wire or the like. Each tie element 72 includes an upper end 73 and a lower end 74. The several lower ends 74 are secured at spaced locations to tray 62 proximate the periphery 67. A slit 75 extends inwardly from the periphery 70 of top 63 in substantial alignment with each point of attachment of lower end 74 of tie element 72. Each tie element 72 extending upwardly from lower end 74 passes through a corresponding slit 75 prior to angling inward where the several upper ends 73 are commonly united to form handle means for carrying the carton assembly. The inward angling of each tie element 72 functions to urge cover 63 downwardly placing the several servers 10 in compression as previously described.

Four tie elements 72 were chosen for purposes of illustration. It will readily occur to those skilled in the art that adequate securement may be had with an alternate number, more or less, of tie elements. It will further be appreciated that two tie elements 72 may be formed of a single endless member which passes through openings within the tray 62. Further, it is noted that for the intended purpose the ends 73 need not be permanently joined.

Flexible strip 77 having ends 78 and 79, lying between tray 62 and cover 63 and within tie elements 72, encircles the several servers 10. While flexible strip 77 may be formed into an endless member by various well known means, it is immediately preferred that a layer of contact adhesive 80 is applied as a strip along edge 79. Edge 79 overlaps edge 78 with adhesive 80 brought into contact with strip 77 such that strip 77 can be readily removed without damage to wrap 27 associated with each server 10. Strip 77 provides a function analogous to previously described lips 47 and 48, and is considered to be optional.

Figure 7:
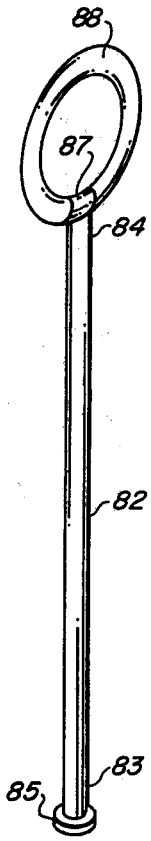
FIG. 7 is a perspective view of an alternate securement element useful in connection with the instant invention.

Securement element 82, seen in FIG. 7, is an alternate embodiment of previously described securement element 43. Securement element 82, in general similarity to securement element 43, includes a lower end 83 which extends through aperture 40 in tray 28 and an upper end 84 which extends through aperture 42 in cover 33. Enlargement 85 resides within indentation 38 and bears against bottom surface 30. Cross member 87, perpendicularly secured to upper end 84, bears against top surface 34 of cover 33.

Preferably, securement element 82 is fabricated of plastic in accordance with conventional practice. Split ring 88 is carried by cross member 87. As will be readily appreciated by those skilled in the art, split ring 88 is pivotably secured to cross member 87. This is accomplished by providing a ball and socket joint between each end of cross member 87 and the respective end of split ring 88. Pivotal joints of the type are considered to be conventional within the art. Split ring 88 functions as a finger ring for carrying the carton assembly of the instant invention. When not in use, split ring 88 is simply folded over against top surface 34 such that one carton assembly may be stacked upon another.

It is immediately apparent that each server 10 is readily removable from the holder without disturbing the other servers. Since each segment is individually wrapped, shelf life is prolonged and each segment is packaged for carry-out. When rotated 90°, placing panel 20 on the bottom as illustrated in FIG. 1, the server functions as a serving unit or dish for supporting the segment during consumption.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described and disclosed the instant invention, and alternately preferred embodiments thereof, in such clear and concise terms as to enable those skilled in the art to understand and practice the same, the invention claimed is:

1. A carton assembly for holding and storing a plurality of individually servable pastry segments, each of said segments having normal top, bottom and sides and a finite height, said carton assembly comprising:

a. a plurality of servers, each adapted to hold one of said pastry segments and having an upright panel having a height greater than the height of a segment, a first and second flap extending from the upright panel, said first flap adapted to be placed under a segment and said second flap adapted to extend over the segment on the first flap, each of said servers adapted to provide an individual serving unit for a segment with the upright panel being the horizontal support element of the serving unit; and b. a holder including i. a tray supporting said plurality of servers, ii. a cover overlying said plurality of servers, said servers extending between the tray and the cover, and iii. retention means for urging said cover towards said tray and for retaining said plurality of servers between said tray and said cover.

2. A carton assembly for holding and storing a plurality of individually servable pastry segments, each of said segments having normal top, bottom and sides and a finite height, said carton assembly comprising:

a. a plurality of servers, each server adapted to hold a pastry segment and having an upright panel having a height greater than the height of said segment; and b. a holder including i. a tray supporting said plurality of servers, ii. a cover overlying said plurality of servers, said servers extending between the tray and the cover, a centrally located aperture through the cover, and iii. retention means for urging said cover toward said tray and for retaining said plurality of servers between said tray and said cover, said retention means including an elongate securement element having i. a lower end secured to said tray at a generally central location, and ii. a deformable free end extending through the aperture in said cover, said deformable free end being entwined to form a nodule bearing upon said cover.

3. A carton assembly for holding and storing a plurality of individually servable pastry segments, each of said segments having normal top, bottom and sides and a finite height, said carton assembly comprising:

a. a plurality of servers, each of said servers holding one of said pastry segments; and b. a holder including i. a tray supporting said plurality of servers, ii. a cover overlying said plurality of servers, a generally centrally located aperture through said cover, iii. retention means for urging said cover towards the tray and for retaining said plurality of servers between said tray and said cover, said retention means including an elongate securement element having i. a lower end secured to said tray at a generally central location, ii. an upper end extending through the aperture through said cover, and iii. a carrying ring pivotally connected to the upper end, said ring being pivotally foldable against said cover.

4. A carton assembly for holding and storing a plurality of individually servable pastry segments, each of said segments having a top, a bottom, sides and a height, said carton assembly comprising:

a. a plurality of servers, each server including an upright panel, a first flap and a second flap extending from said upright panel, the bottom of a pastry segment adapted to be placed on the first flap of each server, the height of the upright panel being greater than the height of a segment, and the second flap extending over the segment of the first flap;

b. a holder including i. a tray supporting said plurality of servers, ii. a cover overlying the plurality of servers and in contact with said servers, iii. retention means for urging said cover toward said tray and for retaining said plurality of servers between said tray and said cover.

5. A carton assembly as defined in claim 4 in which the areas of the first and second flaps substantially coincide with the areas of the tops and bottoms of the segments.

6. A carton assembly as defined in claim 5 in which the upright panel and the first and second flaps of each server are made of an integral sheet of material.

* * * * *